US005163500A

United States Patent [19]

Seaton et al.

[11] Patent Number: 5,163,500

[45] Date of Patent: Nov. 17, 1992

[54] ROLLOVER METHOD FOR METAL CASTING

[75] Inventors: William W. Seaton, Dexter; Gregory W. Seaton, Plymouth, both of Mich.

[73] Assignee: Ford Motor Company, Dearborn, Mich.

[21] Appl. No.: 806,744

[22] Filed: Dec. 13, 1991

[51] Int. Cl.[5] ..... B22D 23/00

[52] U.S. Cl. ..... 164/130; 164/119; 164/136; 164/306; 164/323; 164/337

[58] Field of Search ..... 164/136, 130, 119, 323, 164/337, 306

[56] References Cited

U.S. PATENT DOCUMENTS

| | | | |
|---|---|---|---|
| 2,897,555 | 8/1959 | Nishikiori | 164/136 X |
| 3,863,704 | 2/1975 | Kahn . | |
| 4,008,749 | 2/1977 | Bellocci et al. . | |
| 4,733,714 | 3/1988 | Smith . | |

FOREIGN PATENT DOCUMENTS

| | | | |
|---|---|---|---|
| 884850 | 12/1981 | U.S.S.R. | 164/337 |
| 2080714 | 2/1982 | United Kingdom . | |

OTHER PUBLICATIONS

"Automated Mold Handling for the Cosworth Process", by Seaton-SSK Engrng, Inc. Dec. 3, 1987.

*Primary Examiner*—J. Reed Batten, Jr.
*Attorney, Agent, or Firm*—Roger L. May; Joseph W. Malleck

[57] ABSTRACT

A metallurgically improved metal casting (10) is made with increased productivity, wherein molten metal is quiescently fed upwards into a molding chamber (14) which is then inverted. An assembly of refractory cores (12) is used that defines the molding chamber (14) with riser channels (16). A metal entrance (18) to the molding chamber (14) through a mold side wall (20) requires feeding molten metal against gravity to fill the molding chamber (14), and quiescently pressure feeding molten metal through a metal launder (26) to fill the molding chamber (14) and the riser channels (16). A mold/nozzle connection between the metal launder (26) and the source of molten metal delivered under pressure is rotationally flexible and axially compliant. The feeding of molten metal is interrupted and the assembly is rotated about an axis passing through the mold/nozzle connection (28) to invert the assembly while maintaining the mold/nozzle connection. The mold/nozzle connection (28) is then severed from the inverted assembly. Molten metal is then allowed to feed under gravity into the molding chamber (14) from the riser channels 16 and the metal launder (26) is drained. Meanwhile, the molding chamber (14) is removed from the mold/nozzle connection (28), and a subsequent mold is filled.

15 Claims, 8 Drawing Sheets

ROLLOVER METHOD FOR METAL CASTING

BACKGROUND OF THE INVENTION

1. Field Of The Invention

This invention relates generally to a method of making a metallurgically improved metal casting and the apparatus by which the method is practiced. More particularly, the present invention relates to the art of making a metallurgically improved metal casting with increased productivity by quiescently feeding molten metal from a source thereof into a molding chamber through an in-gate situated below the top of the molding chamber.

2. Background Art

In the past, various types of molding equipment have been used to produce premium quality castings made of a variety of metals, including aluminum. The objective of such equipment generally is to provide a system which meets the objectives of generating a quality product at an acceptable cost.

Previous approaches have been made to the challenge of achieving premium quality cast aluminum parts. Illustrative of such approaches is that disclosed in U.S. Pat. No. 4,733,714 which is assigned to Cosworth Research & Development, Ltd., and which issued on Mar. 29, 1988, the disclosure of which is herein incorporated by reference. While the method and apparatus disclosed therein offers some advantages in achieving acceptable castings, the process is inherently slow and time-consuming. That process, which involves filling a mold "from the bottom" and holding pressure until casting solidification is achieved, limits production to relatively few castings per hour. One of the impediments imposed by such prior art techniques to the goal of achieving a higher throughput is the relatively and complex large equipment mass that must be moved by multiple stations in each cycle. Until the present invention, there remained unsolved the problem of designing a manufacturing facility which exploits the quality achievable by such processes while producing castings at an acceptable rate and cost.

Prior art solutions, such as that disclosed in U.S. Pat. No. 4,733,714 include relatively complex design concepts, which result in only a fair level of reliability. The intricacy of system design often makes lubrication and maintenance more difficult than these essential tasks should be.

SUMMARY OF THE INVENTION

The present invention solves the above problems by providing a method of making a metallurgically improved metal casting with increased productivity.

The method uses an assembly of refractory cores that define a molding chamber with riser channels. The method calls for preparing the assembly for casting by providing a metal entrance to the molding chamber through a mold side wall of the assembly. The assembly is rotationally movable between a first (upright) and second (inverted) position. When the assembly is in the first position, the location of the metal entrance is selected so that it requires feeding molten metal against gravity to fill the chamber. The molding chamber is then quiescently filled with molten metal by a pressure feed through a metal launder and the riser channels. Flow occurs through a mold/nozzle connection through which the molten metal is delivered, and the metal entrance to the assembly. The mold/nozzle connection is rotationally flexible and axially compliant.

After pressure feeding the molten metal to occupy the molding chamber, delivery is interrupted. The assembly is then rotated about an axis passing through the mold/nozzle connection to invert the assembly toward the second (inverted) position while maintaining the mold/nozzle connection. After the mold/nozzle connection is detached from the inverted assembly, molten metal is allowed to feed under gravity into the molding chamber from the riser channels, while draining the metal launder and removing the casting therefrom.

The objects, features, and advantages of the present invention are readily apparent from the following detailed description of the best mode for carrying out the invention when taken in connection with the accompanying drawings.

BRIEF DESCRIPTION OF DRAWINGS

FIG. 16 is taken along the line 16—16 depicted in FIG. 15, with rollers removed for clarity;

DETAILED DESCRIPTION OF PREFERRED EMBODIMENTS

Figure 1:
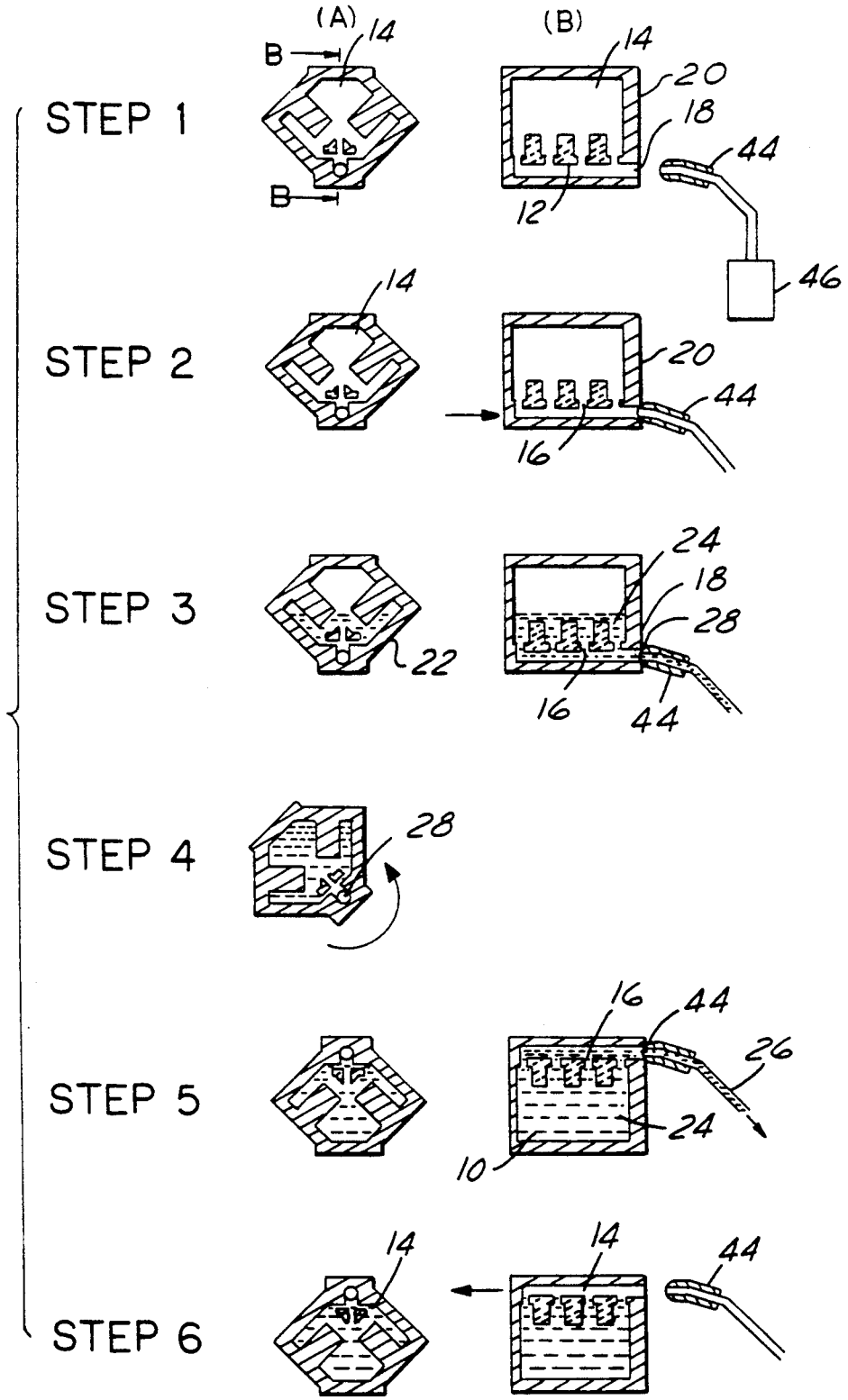
FIG. 1 is a series of diagrammatic crosssectional views through a first embodiment of the invention showing the main process steps (1–6) of mold filling. In steps 1–3 and 5–6, the view (B) is taken along the line B—B of the view depicted in (A). The molding chamber is filled from a metal entrance located at a lower portion of a mold side wall, and inverted (step 4) while pressure is maintained on the metal. The main metal launder is drained, and the casting is allowed to be fed under gravity from riser channels.

Beginning with reference to FIG. 1 of the drawings, there are depicted the main process steps (1-6) involved in a method of making a metallurgically improved metal casting with increased productivity according to the present invention. Throughout this disclosure, it is assumed that the molten metal 24 to be cast is an aluminum alloy. However, any metal castable by low pressure means may be produced with the disclosed system. Such metals include magnesium, zinc, lead, copper, and their alloys. Ferrous metals also may be cast by the disclosed method, depending upon the application of the particular component to be cast.

In FIGS. 1(A)-(B) there is shown an apparatus for making metal castings which uses an assembly of refractory cores 12 that define a molding chamber 14 with riser channels 16. The assembly 12 is prepared for casting by providing a metal entrance 18 to the molding chamber 14 through a mold side wall 20 of the assembly 12. The metal entrance 18 is so configured that in one position 22, the metal entrance 18 requires feeding molten metal 24 against gravity to fill the molding chamber 14.

In step 1 of FIG. 1, the molding chamber 14 is shown in a state of readiness for filling. A nozzle 44 is indicated in a poised position before being mated with the metal entrance 18 disposed in the mold side wall 20 of the molding chamber 14. Connected to the nozzle 44 is a pump 46, or source of pressure feed located in proximity to a furnace for liquefying the metal to be cast.

In step 2 of FIG. 1, the molding chamber 14 is moved axially into juxtaposition with the nozzle 44, as shown by the directional arrow, and is sealed in preparation for filling.

Step 3 of FIG. 1 illustrates the results of operation of the pump 46 which effectively fills the molding chamber 14 with molten metal 24 under precisely controlled conditions. Inspection of step 3 shows that the metal entrance 18 is so situated that it requires the feeding of molten metal 24 against gravity in order to fill the molding chamber 14.

As illustrated in step 4, after the molding chamber 14 is filled, it is rotated about an axis passing through the tip of the nozzle 44 while pump pressure is maintained. It will be appreciated that in order to accomplish inversion of the molding chamber 14 while pressure is maintained, the mold/nozzle connection 28 must be rotationally flexible and axially compliant. During the inversion stage, alignment must be maintained between the metal entrance and the tip of the nozzle 44. Additionally, rotation of the molding chamber 14 must be concentric with the center line of the nozzle 44. Accordingly, the nozzle 44 must be constructed of a suitable material, such as silicon nitride, and should be spherical in order to provide a compliant seal contact during fill (step 3) and rollover (step 4). Use of a carbon washer provides a good fit and relative ease of lubrication.

Step 5 illustrates that after the pump 46 stops, the main metal launder 26 is drained towards the furnace, leaving the riser channel 16 filled with hot metal in order to feed the casting 10 under gravitational forces. The metal launder 26, as shown, extends generally horizontally, but slightly upwardly toward the nozzle 44. It will be appreciated that the metal launder 26 is surrounded by thermally insulating material which may be provided with a heat source. As can be seen, the flow of molten metal is essentially upwards during the filling stage (step 3). As a result, turbulent flow which is often associated with downward filling under gravity is avoided, together with the unwanted capture of oxides and other particles in the casting which might otherwise cause nucleation and propagation sites for defects.

Finally, in step 6 of FIG. 1, the molding chamber 14 is disengaged from the nozzle 44. At this stage, the molding chamber 14 is ready to proceed to cooling, de-gating, and machining.

Figure 2A:
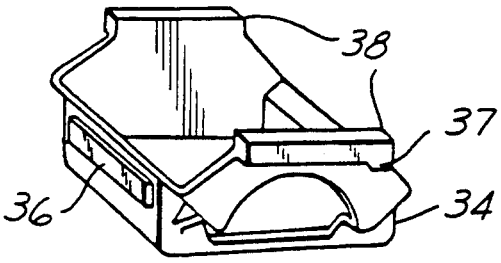
FIGS. 2A–2C are perspective views of the three main stages involved in preparing an assembly of the molding chamber and a pallet.
Figure 2B:
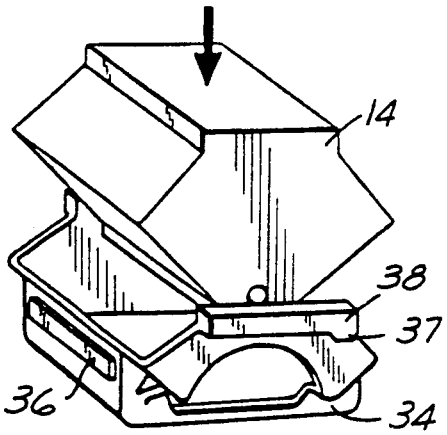
Figure 2C:
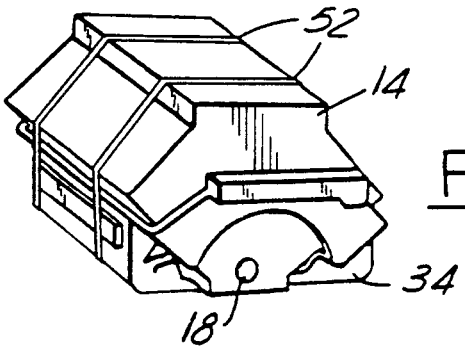

Turning now to FIGS. 2A-2C, there is depicted an assembly comprising the molding chamber 14 and a pallet 34. A study of the molding chamber and handling requirements has resulted in a pallet design 34 which allows a method of positive location, clamping, and transporting of the molding chamber 14 throughout the rollover operation. This is achieved by providing the pallet 34 with support rails or locator bars 38 at each end thereof. Each locator bar 38 has a stop 37 near one end. This stop locates the molding chamber 14 laterally when engaged in a mating locating block 42 (see FIG. 7) which is provided on an end plate of the rollover cage 39. Each locator bar 38 also serves to transport the molding chamber 14 in the inverted position while running on flanged rollers in a manner to be described later.

A locator pad 36 on the side of the pallet 34 serves as a squaring stop when the pallet-mold assembly is moved into the rollover cage 39. In the inverted position, this pad 36 provides a contact surface for transfer arms 62 which serve to push the assembly out of the cage 39. (See FIGS. 4-8.)

In practice, the pallet 34 is made of a material such as ductile iron, and the locator bars 38 on each end of the pallet are made of a hardened alloy. For handling purposes, the mold-pallet assembly is banded with a polymeric enveloping strip 52 which can be pre-tensioned. This band 52 will hold the assembly in place during handling and will secure the molding chamber 14 during filling.

Figure 3:
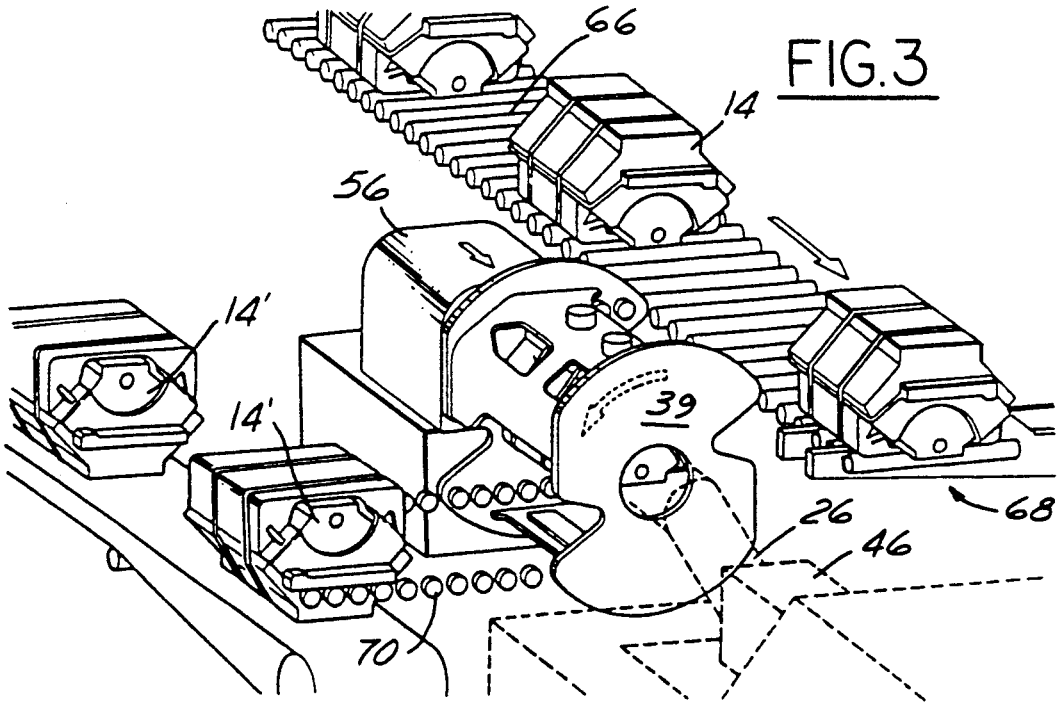
FIG. 3 is a perspective view illustrating the passage of a series of mold-pallet assemblies along a conveyor to a single station at which the molding chamber is filled before inversion.

Continuing now with primary reference to FIG. 3, it will be seen that molding chambers 14 are transported to a rollover loading station 39 by a powered roller conveyor 66, which transports each mold 14 to a pick-up position 68. In practice, the molding chamber 14 is squared and positioned by an air cylinder-actuated arm which moves the mold 14 against positioning lugs or thumbs which are part of the rollover loading-transport arms 62 (to be described later). Also illustrated in FIG. 3 are the source of pressure feed 46, the main metal launder 26, the rollover cage 39, and a rotary drive 56. After leaving the rollover cage 39, the mold-pallet assembly exits therefrom along carry-out and powered rollers 70. The filled mold chamber is represented generally by the reference numeral 14'.

Figure 4:
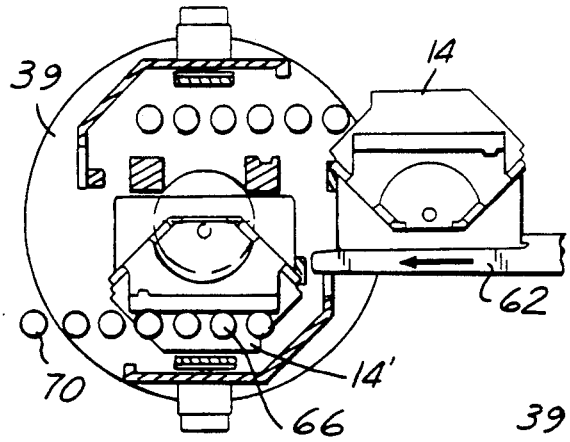
FIG. 4 illustrates how a production cycle of the disclosed method begins with a previously filled mold resting on carrier rollers. A new mold is moved into a rollover station on transfer arms.

Additional details of the main process steps are provided in FIGS. 4–12. FIG. 4 illustrates the commencement of the processing cycle with a previously filled mold 14' resting on carry-out rollers 70. A new (unfilled) mold 14 is moved into the rollover cage 39 on transfer arms 62. Forward movement of a transfer arm 62 occurs over a distance of about 16", whereupon the previously filled mold 14' is contacted by the ends of the transfer arms 62.

Figure 5:
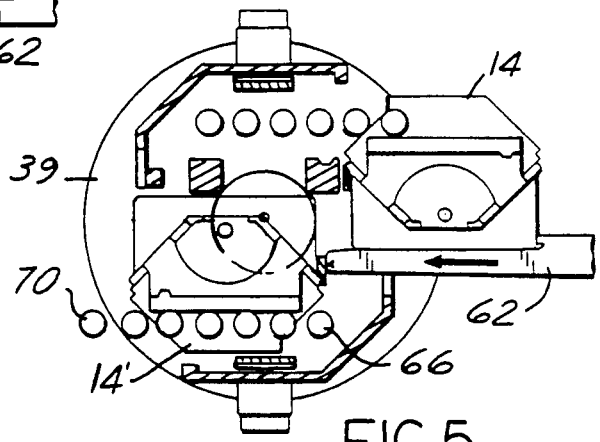
FIG. 5 illustrates that as the new mold proceeds into the rollover station, the transfer arm contacts the previously poured mold and starts expelling it in a single motion from the rollover station.

FIG. 5 illustrates that as the new mold 14 proceeds into the cage 39, the transfer arm 62 contacts the previously poured mold 14' and starts displacing it away from the rollover cage 39. Thus, the load and unload operations occur in a single motion.

Figure 6:
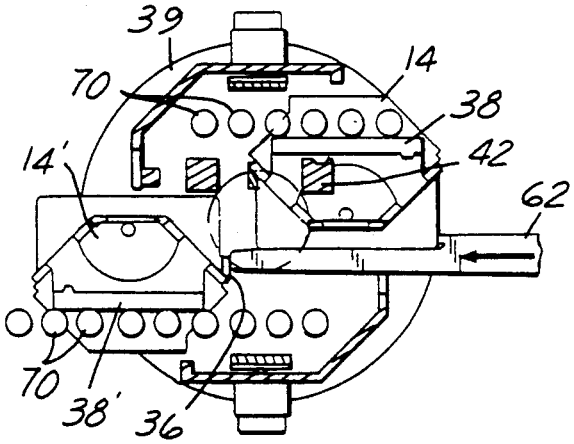
FIG. 6 illustrates that as the new mold proceeds into the rollover station, a pallet locator bar clears rollover locator blocks and carry-out rollers.

FIG. 6 depicts the step in which the new mold 14 proceeds into the rollover cage 39 with the pallet locator bar 38 clearing the rollover locator block 42 and the carry-out rollers 70 thereabove. In practice, the transfer arm 62 decelerates just before contact with the pallet stop blocks 36, after about 40" of travel. The pallet support rails or locator bars 38' of the filled mold 14' now rest on the rollers 70.

Figure 7:
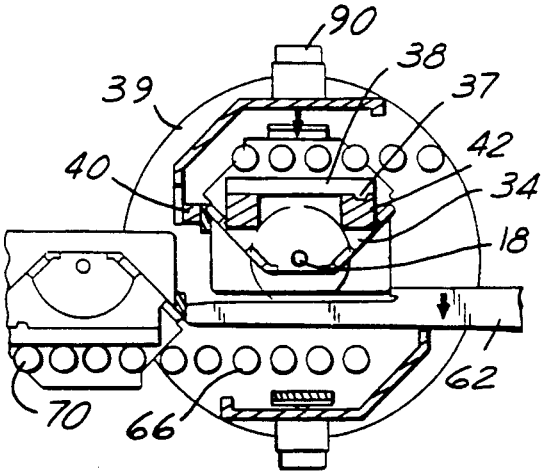
FIG. 7 illustrates how the new mold's pallet contacts stop blocks, and the transfer arm lowers the mold pallet locator bar into contact with the rollover locator blocks. At this stage, the poured mold is carried on powered rollers away from the rollover station.

In FIG. 7, we see the new mold's pallet 34 contacting the stop blocks 40. The transfer arm 62 lowers the mold pallet locator bar 38 into contact with the rollover locator blocks 42. A wedge-type indexing key or stop 37 is incorporated into each of the locating/clamp bars 38, which engages a corresponding recess in the locating blocks 42. In this way, the mold metal entrance 18 is positioned concentrically with the center line of the nozzle 44 (not shown in FIG. 7), which is coaxial with the center of revolution of the rollover cage 39. Pneumatic cylinders actuate to clamp the molding chamber 14 firmly onto the locator blocks 42. The poured mold 14' is situated on powered rollers 70 which transport it away from the rollover cage 39.

Figure 8:
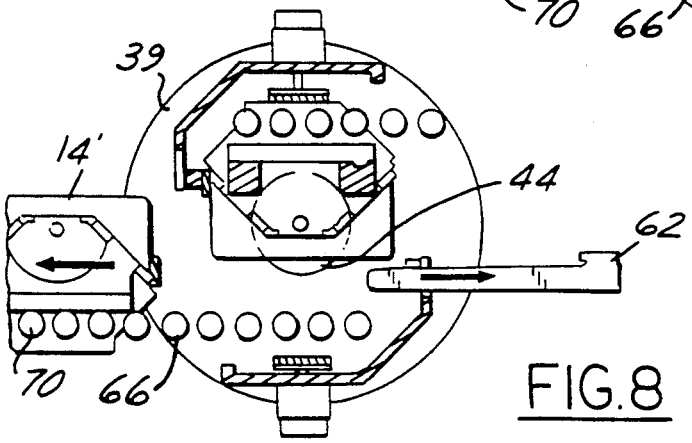
FIG. 8 illustrates how the transfer arm retracts in preparation for pick-up of the next mold, while the poured mold exits from the rollover station. The rollover station then moves axially to engage a nozzle.

FIG. 8 illustrates retraction of the transfer arm 62 in preparation for engaging the next mold. The poured mold 14' exits from the rollover cage 39, which then moves axially (out of the plane of the paper) so that the next unfilled mold 14 may engage the nozzle 44 and form a seal. A load sensing switch (not shown) controls the axial pressure against the nozzle 44.

Figure 9:
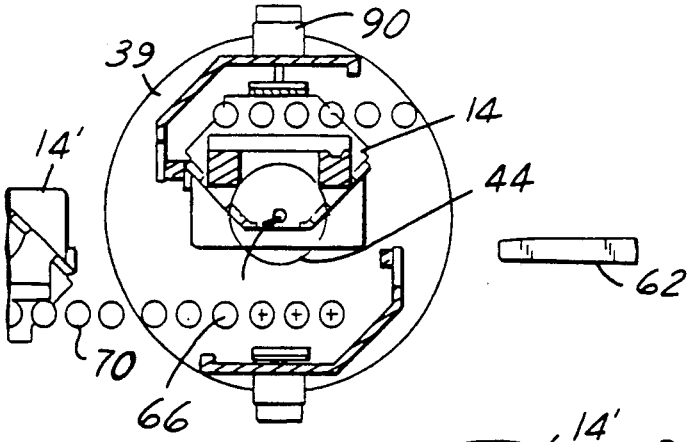
FIG. 9 illustrates the process step wherein the mold is filled under precisely controlled conditions by a nozzle.

FIG. 9 depicts the process step wherein the mold 14 is filled under precisely controlled conditions by molten metal delivered through the nozzle 44. When the mold is filled, a timer and/or a pressure switch emits a signal, upon which the mold is rotated 180° about the center line of the nozzle 44 while pressure is maintained by the pump 46 (not shown).

Figure 10A:
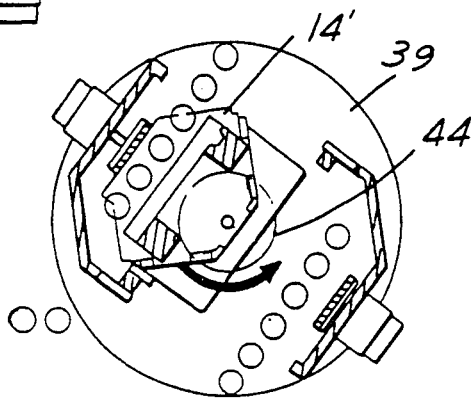
FIGS. 10A and 10B illustrate that after the mold is filled, a rotary drive gently rolls the mold through 180 while pressure is maintained on the liquid metal (FIG. 10A). Meanwhile, the next mold to be poured has moved in place over the transfer arm (FIG. 10B)
Figure 10B:
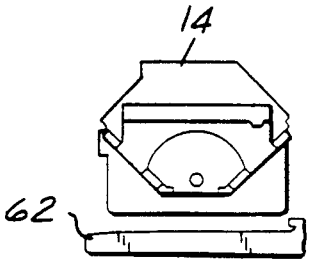

In FIGS. 10A and 10B, after the mold 14 is filled, the rollover cage 39 gently moves the filled mold 14' through 180° of rotation while pressure is maintained on the liquid metal. While the preferred embodiment of the invention disclosed herein calls for the rollover cage 39 to be uni-rotational, an alternative way of practicing the present invention with good results calls for the rollover cage 39 to be reciprocally rotational. Meanwhile, the next mold to be poured, depicted in FIG. 10B, has moved in place over the transfer arm 62.

Figure 11A:
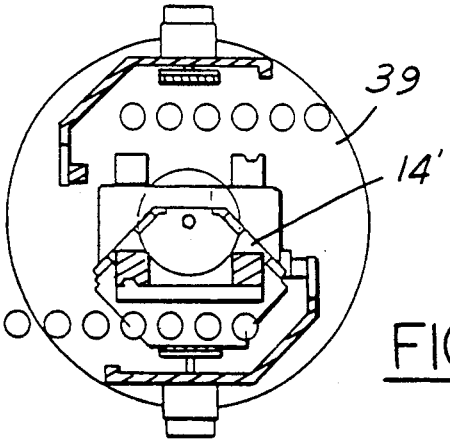
FIGS. 11A and 11B illustrate the equipment configuration when metal in the main metal launder is allowed to drain back into a furnace while the supply of molten metal is de-energized. Meanwhile, the next mold is pre-positioned and lifted by the transfer arm in preparation for the next cycle.
Figure 11B:
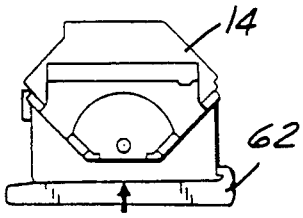

In FIGS 11A and 11B, immediately following pressurized rollover, the source of pressure feed 46 is de-energized, thereby permitting molten metal 24 in the main metal launder 26 to drain back to the furnace. When the mold comes to rest in an inverted position, the pump 46 is stopped, and the main metal launder 26 is drained back into the furnace. The rollover cage 39 then moves axially away (out of the plane of the paper) from the pump orifice 44. Meanwhile, the next mold 14 is pre-positioned and lifted by the transfer arm 62 in preparation for the next cycle.

Figure 12A:
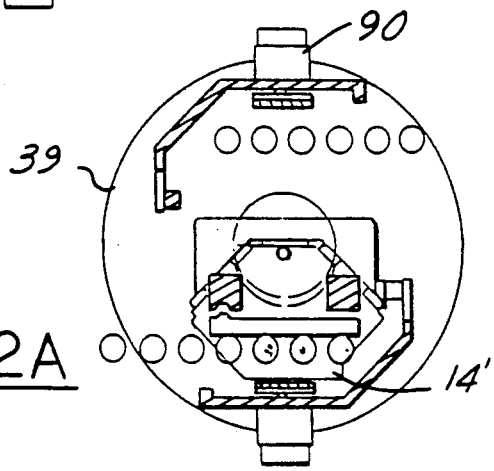
FIGS. 12A and 12B illustrate that the mold is lowered onto the carry-out rollers while a clamp is retracted. After draining, the mold is moved axially to disengage from the nozzle. At this point, the mold is ready to exit the rollover station and proceed to cooling, de-gating, and machining. The next rollover loading cycle is ready to begin.
Figure 12B:
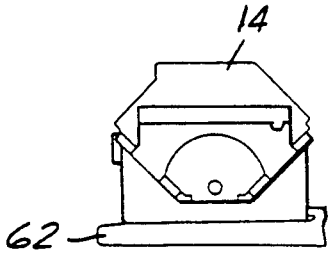

FIGS. 12A and 12B illustrate that the mold 14' is then lowered onto the carry-out rollers (FIG. 12A). After draining, the mold 14 is moved axially to disengage from the nozzle 44. The mold 14' is then ready to exit the rollover cage 39 and proceed to cooling, de-gating, and machining. The next rollover loading cycle is then ready to begin.

Figure 13:
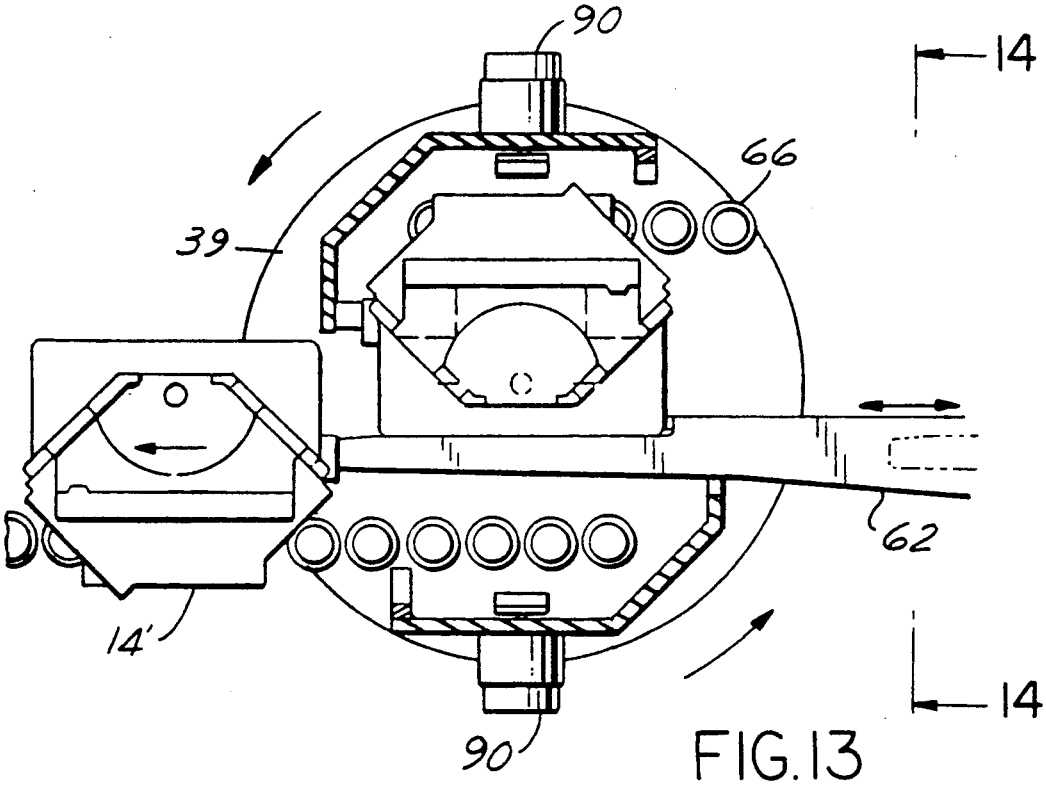
FIG. 13 is a sectional view of the roll-over station taken along the line 13-13 depicted in FIG. 15, showing in greater detail the flanged rollers, the loader, the unloader arms, the mold pallet assembly, and the powered rollers, together with a rotary frame which defines the rollover station.
Figure 14:
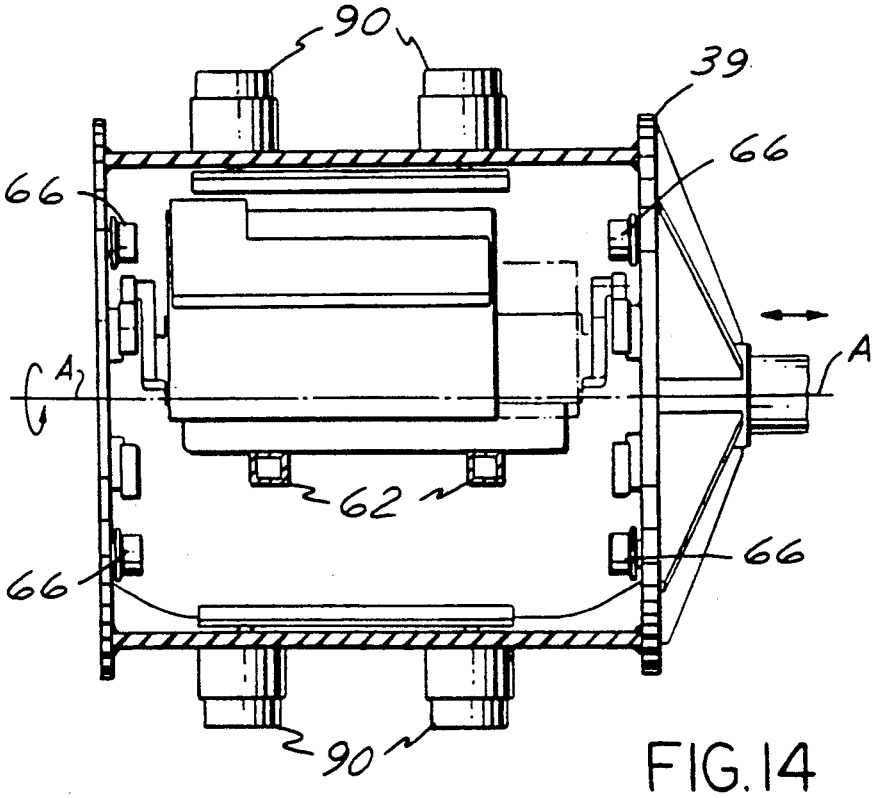
FIG. 14 is a side elevational view of the rollover station depicted in FIG. 13 along the line 14-14 shown therein, with parts broken away for clarity.

For clarity, FIGS. 13 and 14 are included to depict enlarged transverse and longtitudinal sectional views of a single station of the apparatus. Illustrated therein is a pneumatic mold clamp cylinder 90 located on diametrically opposed sides of the rollover over cage 39. Corresponding to the stages depicted in FIGS. 7 and 8, the transfer arm 62 retracts in preparation for picking up the next mold (not shown). The poured mold 14' exits from the rollover cage 39, which then moves axially to engage with the nozzle 44. The axis of rotation is shown by the line A—A in FIG. 14.

Figure 15:
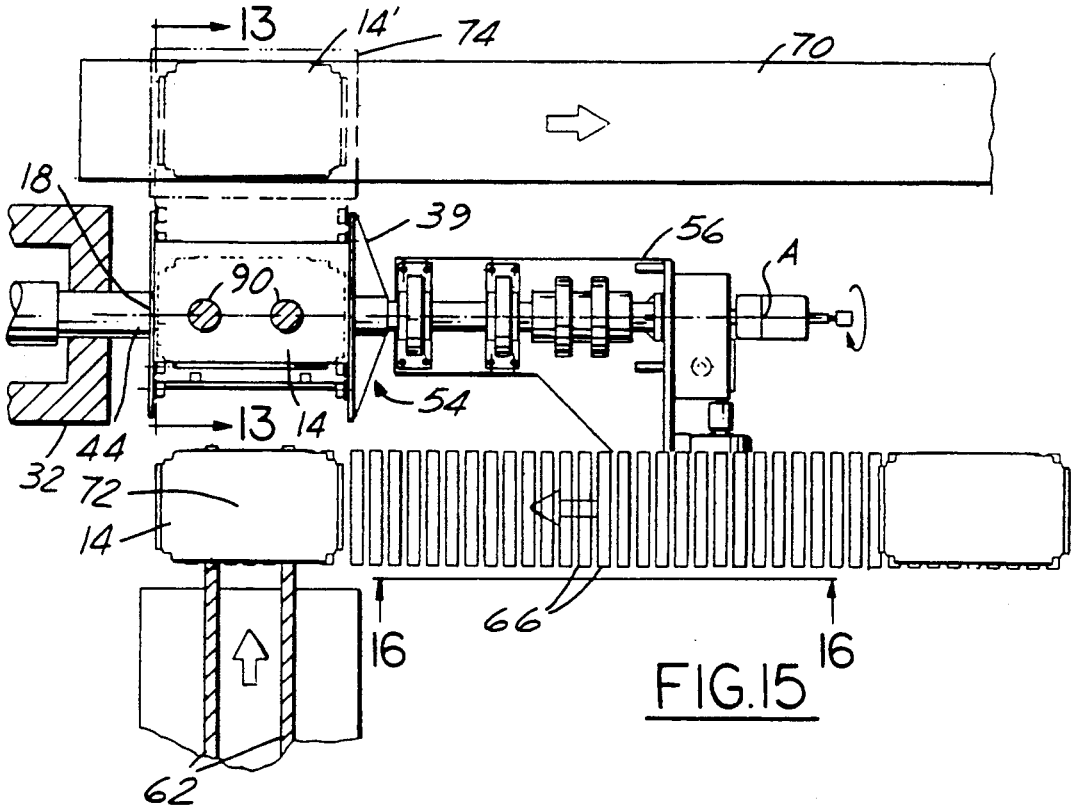
FIG. 15 is a schematic plan view of a facility which includes the disclosed invention, including a loading conveyor, a mold pick-up station, a rollover station, a furnace, the nozzle, a drive train, and a conveyor which transports the filled molds from the nozzle.

Referring now to FIG. 15, diametrically opposed about the nozzle 44 are support seals 32, each seal being the reversed image of the other. In practice, the nozzle 44 has a spherical tip which is adapted to cooperate with a mating spherical seal on the metal entrance 18. For superior fit and ease of lubrication, such components may be made of carbon materials. The nozzle 44 and the metal entrance 18 are compliantly urged together to maintain a seal while the molten metal 24 flows into the molding chamber 14. FIG. 15 is also helpful in illustrating that the rollover cage 39 carries the molding chamber 14 so as to permit connecting the molding chamber 14 to the nozzle 44 at the opposite end of the rollover cage 39 from the rotatable shaft 54 which is propelled by a single motor assembly 56.

Exiting molding chambers 14' proceed down the conveyor 70 for about 8 minutes to ensure complete solidification. The mold-pallet assembly is then secured and the bands 52 severed. The pallet is then lifted from the mold and moved to a pelletizing station while being inverted over 180° during transit. The molding chamber 14' then proceeds to an area for shake-out, de-gating, cleaning, and machining.

Continuing with reference to FIG. 15, the plan view includes the roller conveyor 66, mold pickup station 72, and transfer arms 62. The nozzle 44 is shown in communication with the molding chamber 14 while mounted within the rollover cage 39, which is adapted to rotate cooperatively with the rotary drive 56. After emergence from the rollover cage 39, the filled mold 14' enters a set-on frame 74 before transportation by the carry-out rollers 70.

Figure 16:
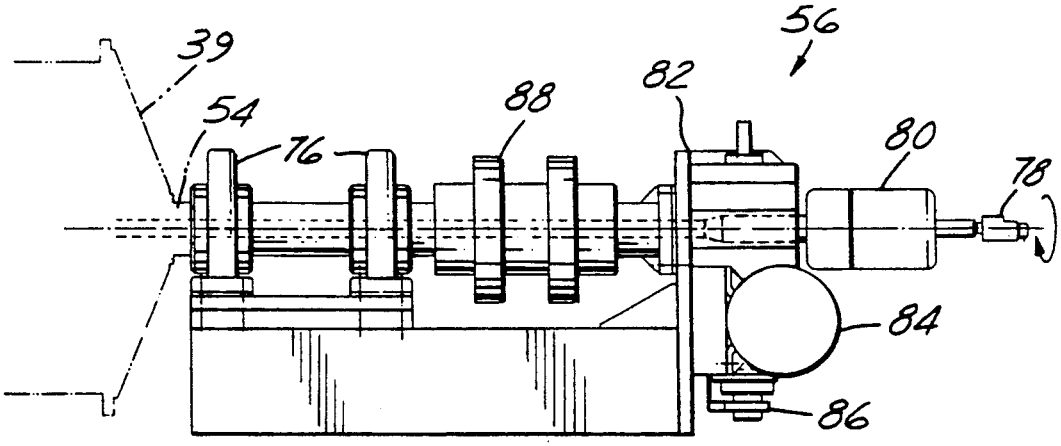
FIG. 16 illustrates in greater detail the drive train used to invert the molding chambers.

Turning now to FIG. 16, the single rotary drive 56 is shown in additional detail. In this figure, a rotating union 78 cooperates with a slip ring assembly 80 and in turn with an indexing drive 82 and a motor 84. Connected to the motor 84 is a torque limiter assembly 86. The indexing drive 82 connects through a double flex coupling 88 and a pillow block bearing 76 ultimately to the rollover cage 39. It will thus be appreciated that the rotary drive system 56 includes the drum-like rollover cage 39 which is cantilevered from the shaft 54 while running in pillow blocks 76, and which is driven by a controlled acceleration/deceleration drive system. The drive system is an integral drive with no external gear or chain connection between the rollover cage 39 and the drive case 82. This design eliminates wear and erratic vibration which could otherwise be introduced into the rollover motion.

The indexing drive 82 produces a modified acceleration profile and minimum inertial torque, resulting in lower stress in the drive train and a gentle mold rollover. The acceleration profile eliminates the disadvantages of other systems in which angular acceleration may approach infinity at the beginning and end of their motion, with peaks at a high negative value toward the midpoint. In comparison, the drive system used herein has a very low start/stop and midpoint angular acceleration, which contributes to reliability and operating life.

In operation, small amounts of metal may fall from the metal entrance 18 when the nozzle 44 is broken as the rollover cage 39 moves away therefrom. To control the splashing of molten metal, carefully located air jets in addition to shields can be used.

To clean the nozzle 44, a brush may be mounted on each side of the transfer arm 62 to abrade the nozzle 44 after each fill cycle as the molds 14 are being transferred.

Figure 17:
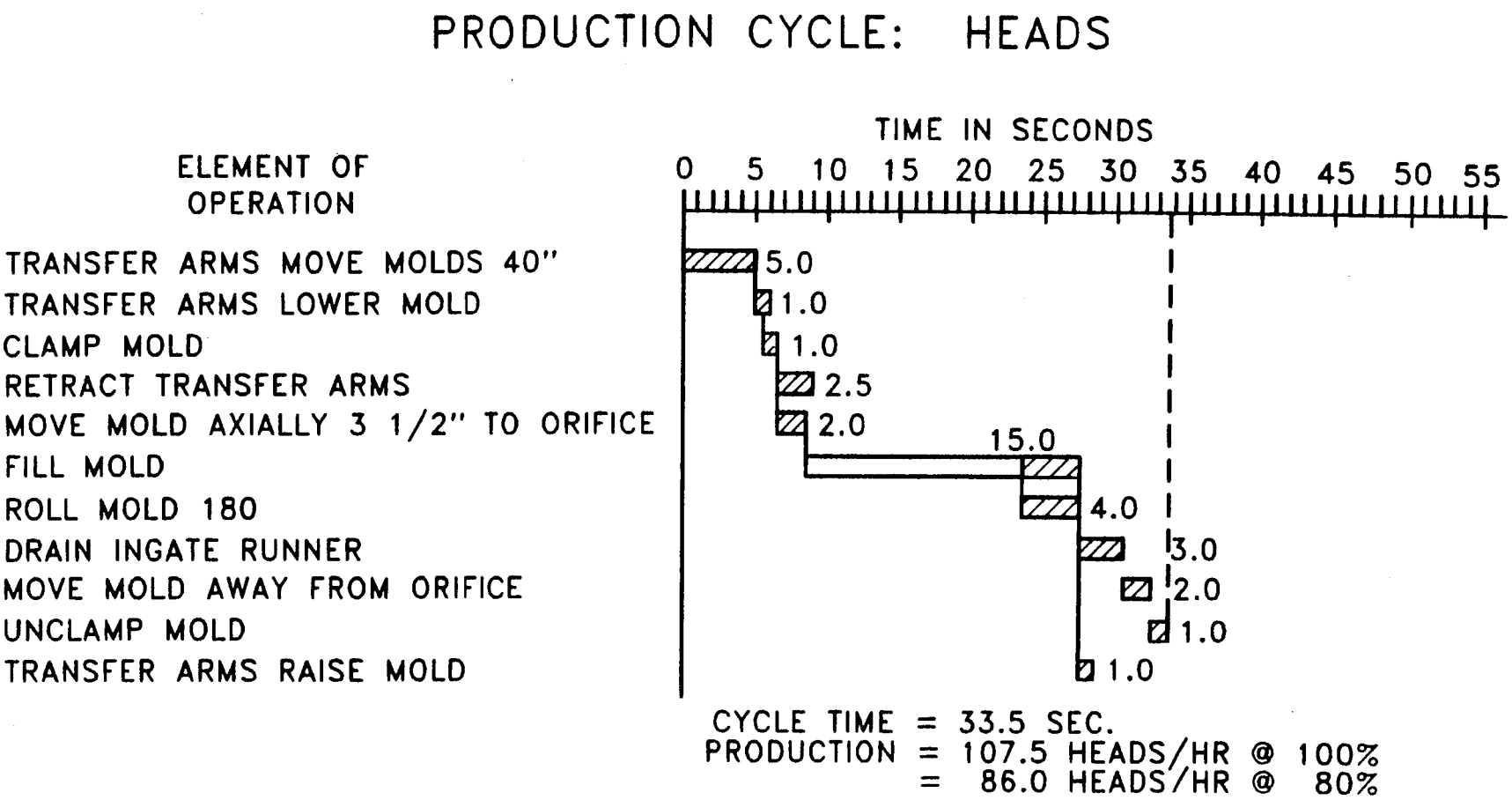
FIG. 17 is a diagrammatic illustration of a typical production cycle showing the chronological relationship of various operational steps involved in producing cylinder heads.
Figure 18:
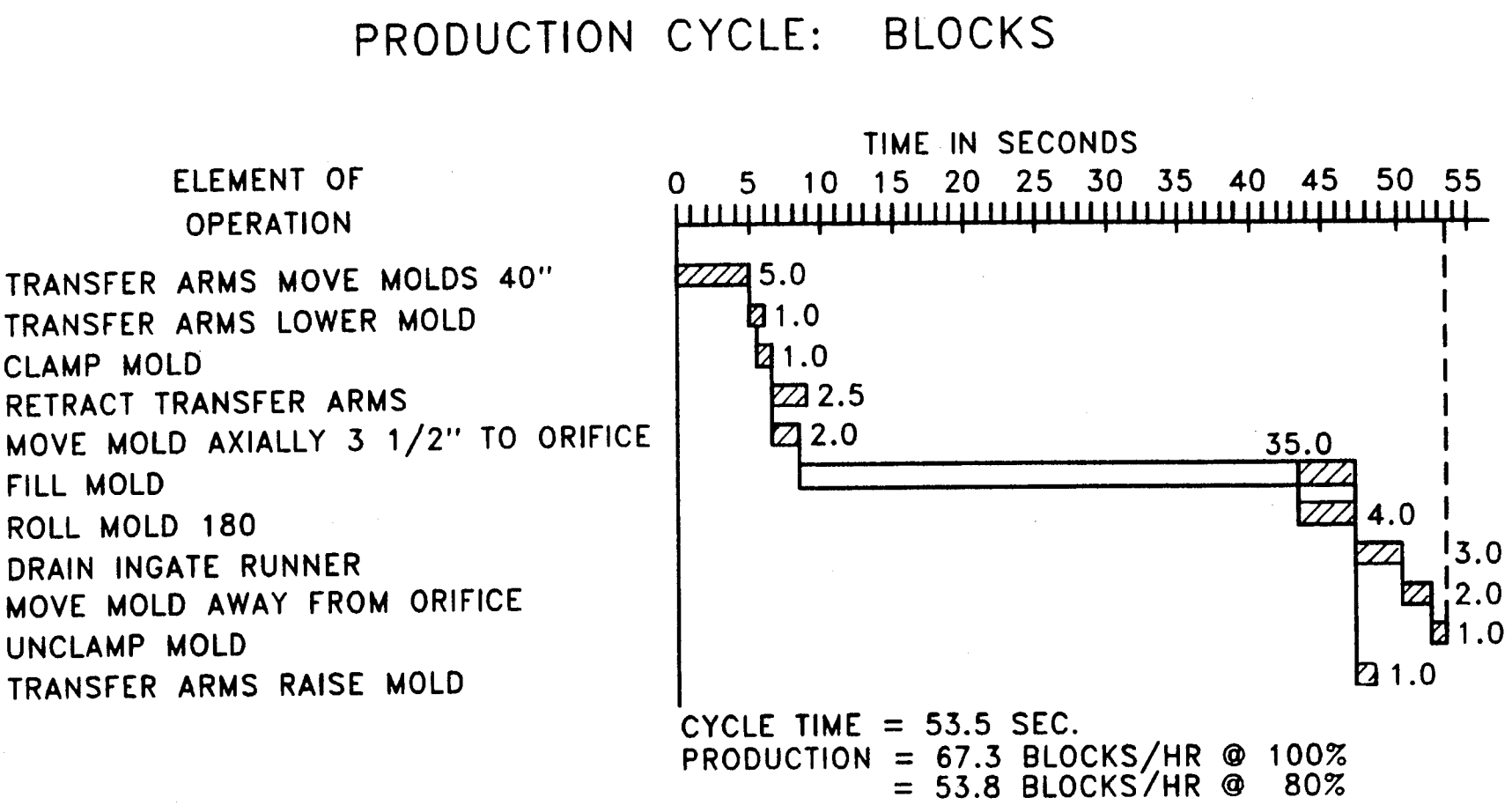
FIG. 18 is a diagrammatic illustration of a typical production cycle showing the chronological relationship of various operational steps involved in producing cylinder blocks.

FIGS. 17 and 18 are helpful in illustrating the chronological relationships of various process steps in the production of cylinder heads (FIG. 17) and cylinder blocks (FIG. 18). Noteworthy is the example wherein cylinder heads are produced during a cycle time of 33.5 seconds with a throughput of 107.5 heads per hour at 100% of capacity, and 86 heads per hour at 80% capacity. When the disclosed method and apparatus are used to produce cylinder blocks, the cycle time is 53.5 seconds. Throughout is 67.3 blocks per hour at 100% capacity and 53.8 blocks per hour at 80% capacity.

Calculations have shown that the ratio of the static weight of the rotating mass to the polar moment of inertia is 1.5 or greater. In practice, the rotational step is performed at angular accelerations of 1.60 radians per second or less.

In light of the previous disclosure, it will be apparent that the invention contributes to the art a system wherein there is only one axis of rotation in each cycle, wherein the loading and unloading of molding chambers 14 is performed in the same motion at a single station with a single rotary drive with a minimum number of moving parts. There is relatively little movement of machine mass in each cycle, and the throughput attained provides a high level of efficiency.

Thus, there has been disclosed a manufacturing system which uses unique equipment to produce good quality castings at a reasonable cost. The disclosed system makes this contribution without the disadvantage of moving a relatively high machine mass during each cycle.

Having thus described the present invention, many modification thereto will become apparent to those skilled in the art to which it pertains without departing from the scope and spirit of the present invention as defined in the appended claims.

We claim:

1. A method of making a metallurgically improved metal casting with increased productivity using an assembly of refractory cores that define a molding chamber with riser channels, comprising the steps of:

preparing the assembly for casting, including providing a metal entrance to the molding chamber through a mold side will of the assembly whereby in a non-inverted position, the metal entrance requires feeding molten metal delivered from a source thereof against gravity to fill the molding chamber;

quiescently pressure feeding molten metal from the source through a meal launder to fill the molding chamber and the riser channels while the chamber is secured in said non-inverted position through a mold/nozzle connection to the metal entrance, the mold/nozzle connection being rotationally flexible and axially compliant;

interrupting the feeding of molten metal and rotating the assembly about an axis of rotation passing through the mold/nozzle connection to invert a rotating mass of the assembly to an inverted position while maintaining the mold/nozzle connection;

detaching the mold/nozzle connection from the inverted assembly;

allowing molten metal to feed under gravity into the molding chamber from the riser channels while draining the metal launder and removing the molding chamber away from the mold/nozzle connection; and removing the inverted assembly by displacing it with a non-inverted assembly.

2. The method of claim 1 wherein the assembly preparation step comprises:

loading the assembly into a selectively rotatable cage adapted for rotating the non-inverted assembly to the inverted assembly about the axis of rotation; and providing support seals diametrically opposed about the mold/nozzle connection, each seal being the reversed image of the other.

3. The method of claim 2 wherein the molding chamber is carried in a pallet having stops and support rails which facilitate loading of the molding chamber into the cage.

4. The method of claim 3 wherein the step of loading the molding chamber and pallet into the cage comprises moving the pallet linearly and horizontally to meet stops disposed on the cage, and lifting the pallet linearly and vertically to engage locator blocks provided integrally with the cage.

5. The method of claim 4 wherein the molding chamber and pallet are clamped to the cage, and the cage, molding chamber and pallet are linearly moved along the axis of rotation to form the mold/nozzle connection between a pressure feed and the metal entrance.

6. The method of claim 1 wherein the mold/nozzle connection communicates with a pressure feed, the connection having a spherical tip adapted to cooperate with a mating spherical seat on the metal entrance, the tip and the seat being compliantly urged together to maintain a seal while the molten metal flows into the assembly.

7. The method of claim 1 wherein the assembly comprises sand supports which cooperate with the refractory cores to define an engine head casting, the metal entrance being located at a level of the assembly below the mid-section of the chamber.

8. The method of claim 7 wherein the cores and the supports are retained together by an enveloping band.

9. The method of claim 2 wherein the rotatable cage is cantilevered at one end of a rotatable shaft for carrying out the inversion step, the cage carrying the assembly so as to permit connecting the assembly to the source of molten metal at the end of the cage from the rotatable shaft.

10. The method of claim 9 wherein the shaft is fixedly connected to a rotary drive so as to permit axial movement of the shaft and thereby effect the mold/nozzle connection.

11. The method of claim 2 wherein the inverted assembly is removed from the cage by displacing it with the non-inverted assembly so that the steps of loading the non-inverted assembly and removing the inverted assembly occur in a single motion.

12. The method of claim 2 wherein the cage is unirotational.

13. The method of claim 2 wherein the cage is reciprocally rotational.

14. The method of claim 1 wherein the inversion step is performed sot that the ratio of the static weight of the rotating mass to the polar moment of inertia is 1.5 or greater.

15. The method of claim 1 wherein the inversion step is performed at angular accelerations of 1.60 Rad/Sec$^2$ or less.

* * * * *